US005677120A

United States Patent [19]

Lushington et al.

[11] Patent Number: 5,677,120

[45] Date of Patent: Oct. 14, 1997

[54] TELLURIUM COMPLEXES AS CHEMICAL SENSITIZERS FOR SILVER HALIDES

[75] Inventors: Kenneth James Lushington; Henry James Gysling, both of Rochester, N.Y.

[73] Assignee: Eastman Kodak Company, Rochester, N.Y.

[21] Appl. No.: 653,735

[22] Filed: May 23, 1996

[51] Int. Cl.[6] ..... G03C 1/00; G03C 1/09

[52] U.S. Cl. ..... 430/603; 430/569; 430/600

[58] Field of Search ..... 430/600, 603, 430/569

[56] References Cited

U.S. PATENT DOCUMENTS

| | | | |
|---|---|---|---|
| 4,144,062 | 3/1979 | Lelental et al. . | |
| 4,152,155 | 5/1979 | Lelental et al. . | |
| 4,188,218 | 2/1980 | Gysling . | |
| 4,251,623 | 2/1981 | Gysling . | |
| 5,422,232 | 6/1995 | Asami et al. . | |
| 5,424,178 | 6/1995 | Tsuzuki | 630/611 |
| 5,429,916 | 7/1995 | Ohshima . | |

FOREIGN PATENT DOCUMENTS

| | | |
|---|---|---|
| 0 599 690 | 6/1994 | European Pat. Off. . |
| 0 661 589 | 11/1994 | European Pat. Off. . |
| 1308762 | 3/1973 | United Kingdom . |
| 1396696 | 6/1975 | United Kingdom . |
| 94/03534 | 2/1994 | WIPO . |
| 96/04189 | 2/1996 | WIPO . |

OTHER PUBLICATIONS

Olav Foss and Knut Maartmann–Moe, Crystal Structures of Tetrakis(thiourea)tellurium(II) Salts. Orientations of Ligands, Acta Chemica Scandinavica A 41, 1987, pp. 310–320.

Olav Foss and Knut Maartmann–Moe, Crystal Structures of Three Tellurium(II)–Selenourea (su) Complexes: $Te(su)_2Cl_2$, $Te(su)_2Br_2$ and $[Te_2(su)_6](SCN)_4$, Acta Chemica Scandinavica A41, 1987, p. 321–327.

*Primary Examiner*—Thorl Chea

*Attorney, Agent, or Firm*—Paul A. Leipold

[57] ABSTRACT

The invention is generally accomplished providing a silver halide emulsion comprising silver halide grains and a tellurium compound represented by Formula I:

$TeL_nX_2$ wherein

L is thiourea or substituted thiourea, n is 2 or 4,

X is Cl, Br, I, OCN, SCN, SeCN, TeCN, or $N_3$ or Formula II

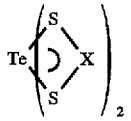

wherein

X is COR, CSR, $CNR_2$, CR, CAr, $PR_2$, $P(OR)_2$

R is alkyl or aryl.

20 Claims, No Drawings

TELLURIUM COMPLEXES AS CHEMICAL SENSITIZERS FOR SILVER HALIDES

FIELD OF THE INVENTION

The invention relates to compounds utilized in chemical sensitization of silver halide compounds. It particularly relates to tellurium compounds utilized in chemical sensitization of silver halides utilized in color negative film or black-and-white film.

BACKGROUND OF THE INVENTION

Photographic silver halide materials are often chemically sensitized with one or more compounds containing labile atoms of gold, sulfur or selenium and the like to provide increased sensitivity to light and other sensitometric properties. Examples of typical chemically sensitized photographic silver halide emulsions are described in, for example, *Research Disclosure*, Item No. 308119, December 1989, Section III, and the references listed therein (*Research Disclosure* is published by Kenneth Mason Publications Ltd., Dudley Annex, 12 North Street, Emsworth, Hampshire PO 10 7DQ, England.) In *Research Disclosure*, Item No. 36544, September 1994, Section IV, page 510, there are a variety of chemical sensitizers disclosed.

A variety of inorganic and organic derivatives of tellurium has been described as chemical sensitizers. Inorganic tellurium sensitizers that have been described include elemental tellurium (J. S. Dunn, Canadian Patent 800,958 (1968; Eastman Kodak Co.), sodium telluride ($Na_2Te$) and hydrogen telluride ($H_2Te$) (P. J. Hillson and M. J. Simons, British Patent 1,295,462 (1972; Kodak Ltd.) and $Na_2\{Te(S_2O_3)_2\}.2H_2O$ (M. J. Simons, British Patent 1,396,696 (1975; Kodak Ltd.).

Organotellurium compounds described as chemical sensitizers include tellurourea derivatives (e.g.,

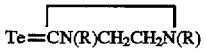

($R=CH_3$, $C_2H_5$), as described in U.S. Pat. No. 5,273,872 (1993; Fuji), U.S. Pat. No. 5,273,874 (1993; Fuji), U.S. Pat. No. 5,395,745 (1995; Fuji) and U.S. Pat. No. 5,459,027 (1995; Fuji), and European Patent Applications 0 573 649 A1 (1993; Fuji), 0 619 515 A1 (1994; Fuji), 0 542 306 A1 (1993; Fuji), and 0 661, 589 A1 (1995; Fuji)), telluroesters (e.g., $C_6H_5C(Te)OCH_2C_6H_5$, as described in U.S. Pat. No. 5,273,874 (1993; Fuji)), and telluroamides (e.g., $C_6H_5C(Te)N(CH_3)_2$, as described in U.S. Pat. No. 5,273,874 (1993; Fuji) and U.S. Pat. No. 5,459,027 (1995; Fuji)).

Phosphine tellurides (e.g., $Te=P(i\text{-}C_3H_7)_2(n\text{-}C_4H_9)$, $Te=P(i\text{-}C_3H_7)_2(i\text{-}C_4H_9)$, $Te=P(i\text{-}C_4H_9)_3$, $Te=P(N(CH_3)_2)_3$ and $Te=P(O\text{-}n\text{-}C_4H_9)_3$) have also been described as chemical sensitizers in U.S. Pat. No. 5,215,880 (1993; Fuji), U.S. Pat. No. 5,273,872 (1993; Fuji), U.S. Pat. No. 5,395,745 (1995; Fuji) and U.S. Pat. No. 5,459,027 (1995; Fuji) and European Patent Applications 0 572 662 A1 (1993; Fuji), 0 572 663 A1 (1993; Fuji), 0 573 649 A1 (1993; Fuji), 0 619,515 A1 (1994; Fuji), and 0 542 306 A1 (1993; Fuji).

Generally tellurium(2+) coordination complexes have not been described as chemical sensitizes for silver halide emulsions. The only Te(II) complex described as a chemical sensitizer is the Te(II) thiosulfate complex, $Na_2\{Te(S_2O_3)_2\}.2H_2O$ which is claimed as a chemical sensitizer in M. J. Simons, British Patent 1,396,696 (1975). This complex, however, is rather unstable, readily undergoing decomposition to elemental tellurium on storage at room temperature, precluding its use as a practical emulsion sensitizer.

Tellurium complexes have been described as components of non-silver imaging elements, e.g., in nonaqueous solution physical developers 1)
   (a) H. J. Gysling U.S. Pat. No. 4,251,623 (1981; Eastman Kodak Co.)
   (b) H. J. Gysling U.S. Pat. No. 4,188,218 (1980; Eastman Kodak Co.)

and in thermally processed dry physical development elements 2)
   (a) M. Lelental and H. J. Gysling, U.S. Pat. No. 4,152,155 (1979; Eastman Kodak Co.)
   (b) M. Lelental and H. J. Gysling, U.S. Pat. No. 4,144,062 (1979; Eastman Kodak Co.).

The prior tellurium chemical sensitizers generally comprise compounds that suffer from the following disadvantages:

1) they exhibit poor thermal stability, undergoing decomposition to elemental tellurium on storage at room temperature
2) they require multistep syntheses under inert atmosphere conditions
3) they readily undergo decomposition on exposure to air.

PROBLEM TO BE SOLVED BY THE INVENTION

However, while the prior chemical sensitizers have been successful, there is a continuing need for chemical sensitizers that are more efficient and stable in providing additional sensitization to silver halide emulsions. There is also a continuing need for low cost sensitizers that can be prepared in good yield and exhibit stability under ambient conditions.

SUMMARY OF THE INVENTION

It is an object of the invention to provide improved chemical sensitizers for silver halide emulsions.

It is a further object of the invention to provide silver halide emulsions of greater sensitivity.

These and other objects of the invention generally are accomplished by a silver halide emulsion comprising silver halide grains and a tellurium compound represented by Formula I:

$$TeL_nX_2$$

wherein

L is thiourea or substituted thiourea, n is 2 or 4,

X is Cl, Br, I, OCN, SCN, SeCN, TeCN, or $N_3$ or

Formula II

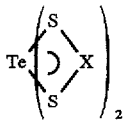

wherein

X is COR, CSR, $CNR_2$, CR, CAr, $PR_2$, $P(OR)_2$

R is alkyl or aryl.

ADVANTAGEOUS EFFECTS OF THE INVENTION

An advantage of the invention is highly sensitized silver halide emulsions. Another object is to provide stable tellurium sensitizers.

DETAILED DESCRIPTION OF THE INVENTION

The invention tellurium sensitizers have not been previously utilized as chemical sensitizers. The tellurium compounds of the invention have numerous advantages over prior materials. The Te(II) coordination complexes of this invention give improved sensitization compared to prior art tellurium sensitizers. The Te(II) coordination complexes of this invention exhibit enhanced stability under ambient keeping conditions compared to prior art tellurium sensitizers. The Te(II) coordination complexes of this invention can be prepared in high yields by convenient synthetic procedures.

Tellurium (II) coordination complexes with monodentate and bidentate sulfur ligands have been described in the open literature:

(a) O. Foss, Pure Appl. Chem., 24, 31(1970)

(b) S. Husebye, Phosphorus and Sulfur, 38, 271(1988)

(c) I. Haiduc, R. B. King, and M. G. Newton, Chem. Rev., 94, 301(1994).

Any tellurium compound as set forth in Formula I or Formula II is a suitable sensitizer. The preferred sensitizers have been found to be the Formula II compounds because of their increased stability under ambient conditions compared to sensitizers of Formula I. The most preferred compounds are the following Formula II compounds that provide a dramatic increase in sensitization, are low in cost, and stable:

$Te(S_2COEt)_2$
$Te(S_2CO\text{-}i\text{-}Pr)_2$
$Te(S_2CO\text{-}i\text{-}Bu)_2$
$Te(S_2COC_{12}H_{25})_2$
$Te\{S_2CN(CH_2CH_2OH)_2\}_2$ Typical compounds of the Formula I and Formula II suitable for the invention are listed in Table 1 below.

TABLE 1

EXAMPLES OF Te(II) COORDINATION COMPLEXES

Formula I $TeL_nX_2$

L=thiourea or substituted thiourea selenourea or substituted selenourea n=2, 4

$Te(thiourea)_2Cl_2$
$Te(thiourea)_2Br_2$
$Te(thiourea)_2I_2$
$Te(thiourea)_2(SCN)_2$
$Te(thiourea)_4Cl_2$
$Te(thiourea)_4Br_2$
$Te(thiourea)_4(SCN)_2$
$Te(N\text{-methylthiourea})_2Cl_2$
$Te(N,N\text{-dimethylthiourea})_2Cl_2$
$Te(N,N'\text{-dimethylthlourea})_2Cl_2$
$Te(N\text{-naphthylthiourea})_2Cl_2$
$Te(N\text{-naphthylthiourea})_4Cl_2$
$Te(ethylenethiourea)_2Cl_2$
$Te(ethylenethiourea)_2Br_2$
$Te(ethylenethiourea)_2(SCN)_2$
$Te(ethylenethiourea)_4Cl_2$
$Te(N\text{-phenylthiourea})_2Cl_2$
$Te(N,N'\text{-diphenylthiourea})_2Br_2$
$Te(N,N\text{-dibutyl-}N'\text{-phenylthiourea})_2Br_2$ Formula II

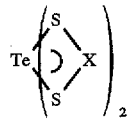

X=
COR
CSR
$CNR_2$
CR, CAr
$PR_2$
$P(OR)_2$ $Te(S_2COEt)_2$
$Te(S_2COCH_2CH_2OMe)_2$
$Te(S_2CO\text{-}n\text{-}C_3H_7)_2$
$Te(S_2CO\text{-}i\text{-}C_3H_7)_2$
$Te\{S_2CO\text{-}C(H)(CH_3)CH_2CH_2OMe\}_2$
$Te(S_2CO\text{-}n\text{-}C_4H_9)_2$
$Te(S_2CO\text{-}i\text{-}C_4H_9)_2$
$Te(S_2CO\text{-}n\text{-}C_5H_{11})_2$
$Te(S_2CO\text{-}n\text{-}C_7H_{15})_2$
$Te(S_2CO\text{-}n\text{-}C_{12}H_{25})_2$
$Te\{S_2CN(CH_2CH_2OH)_2\}_2$
$Te\{S_2CN(CH_3)(CH_2CH_2OH)\}_2$
$Te\{S_2CN(n\text{-}C_4H_9)_2\}_2$
$Te\{S_2P(OMe)_2\}_2$
$Te\{S_2P(OEt)_2\}_2$
$Te\{S_2P(O\text{-}n\text{-}Pr)_2\}_2$
$Te\{S_2P(O\text{-}i\text{-}Pr)_2\}_2$
$Te\{S_2P(O\text{-}n\text{-}C_7H_{15})_2\}_2$
$Te\{(S_2P(cyclo\text{-}C_6H_{11})_2\}_2$
$Te(S_2PPh_2)_2$
$Te\{S_2P(i\text{-}C_3H_7)_2\}_2$ The L thiourea or selenourea of Formula I may be substituted with 1–4 alkyl or aryl substituents on its 2 nitrogen atoms such as:

$$RR'NC(=E)NR''R'''$$

E=S, Se; R, R', R'', R'''=alkyl substituents such as methyl, ethyl, propyl, iso-propyl, n-butyl, iso-butyl, n-amyl, iso-amyl, hexyl, cyclohexyl, heptyl, octyl, nonyl, decyl, dodecyl, etc. or aryl such as phenyl, p-tolyl, p-anisyl, pentafluorophenyl, naphthyl.

The tellurium complexes of the invention may be utilized in any suitable amount. Typically the tellurium compounds would be utilized in an amount between about 0.1 and 100 μmol/mol Ag. Preferably they would be utilized in an amount between about 5 and 50 μmol/mol Ag.

The tellurium complexes of the invention may be added to a silver halide emulsion at various stages during emulsion preparation and finishing. They may be added during emulsion formation, or they may be added after emulsion formation and after washing of the emulsion. They may be added prior to a heat cycle for chemical sensitization or they may be added during the heat cycle after the emulsion has been brought to an increased temperature. It is preferred that they be added either prior to or during the sensitization cycle. The heat cycle is preferably carried out at a temperature of between about 30° and 90° C. with a preferred temperature of addition being between 40° and 70° C. The addition may take place prior to heating or after heating has taken place. The tellurium sensitizing compounds may be added singly or in combination with other sensitizing agents. They also may be added to a silver halide emulsion along with silver ion ligands and silver halide growth modifiers or stabilizers and antifogging agents. Further, the tellurium complexes of the invention may be added with other chemical sensitizing agents such as sulfur, selenium, or noble metal compounds such as those of gold, palladium, platinum, rhodium, or iridium compounds or with dopants such as iron, iridium, rhodium, ruthenium, or osmium complexes. They may be added in the presence of spectral sensitizing dyes. The tellurium complexes may be added during formation of silver halide grains, during the physical or chemical ripening stage, or in a separate step immediately prior to coating to form a photographic element.

This invention provides a process for chemical sensitization of a silver halide emulsion formed according to any of the processes generally well known in the art. A double jet-type process is preferred. The silver halide grains can comprise mixed or single halide components and especially include chloride, bromide, iodide, iodochloride, iodobromide or chlorobromide grains. They can also be different morphologies such as cubic, octahedra, tabular, or tetradecahedral. The chemical sensitizers of the invention are also suitable for core shell emulsions in which the composition and properties of a silver halide grains core are significantly different than the silver halide composition and properties on the surface of the grains.

The double-jet process comprises adding an aqueous silver nitrate solution and an aqueous solution of one or more halides, for example, an alkali metal halide such as potassium bromide, potassium chloride, potassium iodide or mixtures thereof, simultaneously to a stirred solution of a silver halide protective colloid through two separate jets.

Gelatin is preferred as the binder or protective colloid for the photographic emulsion of the present invention. However, other hydrophilic colloids are also suitable. For example, proteins such as gelatin derivatives, graft polymers of gelatin and other polymers, albumin, casein, cellulose derivatives such as hydroxyethyl cellulose, carboxymethyl cellulose and cellulose sulfate, sugar derivatives such as sodium alginate, starch derivatives and various synthetic peptizers such as hydrophilic homopolymers or copolymers such as polyvinyl alcohol, poly-N-vinylpyrrolidone, polyacrylic acid, polymethacrylic acid, polyacrylamide, polyvinylimidazole and polyvinyl pyrazole can be used.

Acid-processed gelatin can be used, as well as lime-processed gelatin. Further, gelatin hydrolyzates and enzyme-hydrolyzed products of gelatin are also usable.

Surface-active agents may be incorporated in a photographic emulsion layer or in another hydrophilic colloid layer as a coating aid to prevent buildup of static charge, to improve lubrication properties, to improve emulsion dispersion, to prevent adhesion and to improve other properties.

A photosensitive material of the present invention may contain antifogging agents or emulsion-stabilizing agents such as, for example, azaindenes, disulfides, thionamides, azoles and the like.

The photographic silver halide emulsions as described can be used in photographic silver halide elements in any of the ways and for purposes known in the photographic art.

The photographic silver halide emulsions can be used and incorporated in photographic elements that are black and white, single color elements or multicolor elements. Multicolor elements contain dye image-forming units sensitive to each of the three primary regions of the visible spectrum. Each unit can be comprised of a single emulsion layer or of multiple emulsion layers sensitive to given regions of the spectrum. The layers of the element can be arranged in various orders as known in the art.

In the following discussion of suitable materials for use in emulsions and elements of the invention, reference will be made to *Research Disclosure,* Number 365 of September 1994. *Research Disclosure* is published by Kenneth Masons Publications Ltd., Dudley Annex, 12 North Street, Emsworth, Hampshire PO 10 7DQ, England. This publication will be identified hereafter by the term "Research Disclosure".

The silver halide emulsions of the invention can be used in elements that can be either negative-working or positive-working. The emulsions in which the described new chemical sensitizers can be used are described in, for example, *Research Disclosure* Sections I, II and III and the publications and patents cited therein. Useful vehicles for the emulsion layers and other layers of elements of the invention are described in *Research Disclosure* Section IX and the publications cited therein.

The described photographic emulsions can be used in color photographic elements with couplers as described in *Research Disclosure* Section X and the publications cited therein. The couplers can be incorporated in the elements and emulsions as described in *Research Disclosure* Section XI and ways known in the art.

The photographic elements and emulsions as described can contain addenda known to be useful in photographic elements and emulsions in the photographic art. The photographic elements and emulsions as described can contain, for example, brighteners (see *Research Disclosure* Section VI); antifoggants and stabilizers (see *Research Disclosure* Section VII); antistain agents and image dye stabilizers (see *Research Disclosure* Section X); light absorbing and scattering materials (see *Research Disclosure* Section II); hardeners (see *Research Disclosure* Section IX); coating aids (see *Research Disclosure* Section IX); plasticizers and lubricants (see *Research Disclosure* Section IX); antistatic agents (see *Research Disclosure* Section IX); matting agents (see *Research Disclosure* Section IX); and development modifiers (see *Research Disclosure* Section XVIII).

The photographic silver halide materials and elements as described can be coated on a variety of supports as described in *Research Disclosure* Section XV and the publications cited therein.

The photographic silver halide materials and elements as described can include coarse, regular and fine grain silver halide crystals or mixtures thereof and can be comprised of any photographic silver halides known in the photographic art.

The photographic silver halide materials as described can be spectrally sensitized by means and dyes known in the photographic art, such as by means of spectral sensitizing dyes as described in, for example, *Research Disclosure* Section V and the publications cited therein. Combinations of spectral sensitizing dyes are especially useful.

Photographic materials and elements as described can be exposed to actinic radiation, typically in the visible region of the spectrum, to form a latent image as described in *Research Disclosure* Section XVI and then processed to form a visible image as described in, for example, *Research Disclosure* Section XVIII using developing agents and other processing agents known in the photographic art. Processing to form a visible image, typically a dye image, includes the step of contacting the element with a developing agent, typically a color developing agent, to reduce developable silver halide and oxidize the developing agent. In a color material the oxidized color developing agent in turn reacts with couplers to yield a dye.

The photographic silver halide materials can also be used in physical development systems as described in *Research Disclosure* Section XVII, in image-transfer systems as described in *Research Disclosure* Section X, in dry development systems as described in *Research Disclosure* Section XVII and in printing and lithography materials as described in *Research Disclosure* Section XIX.

The photosensitive materials obtained by the present invention can be processed according to known methods. A developer to be used for the black-and-white processing can contain conventional developing agents such as dihydroxybenzenes (e.g., hydroquinone), 3-pyrazolidones (e.g., 1-phenyl-3-pyrazolidone), amino-phenols (e.g., N-methyl-p-amino-phenol), 1-phenyl-3-pyrazolidones or ascorbic acids.

As color-developing agent, there can be used primary aromatic amine developing agents such as phenylenediamines (e.g., 4-amino-N,N-diethylaniline, 3-methyl-4-amino-N,N-diethylaniline, 4-amino-3-methyl-N-hydroxyethylaniline, 3-methyl-4-amino-N-ethyl-N-hydroxyethylaniline, 3-methyl-4-amino-N-ethyl-N-methanesulfonamido-ethylaniline and 4-amino-3-methyl-N-ethyl-N-methoxyethylaniline. In addition, the developing agents described in L. F. A. Mason, *Photographic Processing Chemistry* (Focal Press, 1966), pp. 226–229, as well as those described in U.S. Pat. Nos. 2,193,015 and 2,592,364 may be used.

The photographic emulsions of the present invention can be used in many different silver halide photographic light-sensitive materials due to its high photographic sensitivity, contrast, and fog reduction. For example, it can be used in high speed black-and-white negative films, in X-ray films and in multilayer color negative films.

The invention is particularly suitable for use with tabular silver bromoiodide grains which find their preferred use in color negative films. In such films it is particularly important that higher speeds be obtained, as there is a continuing need for higher speed films for color negative photography.

The following examples illustrate the practice of this invention. They are not intended to be exhaustive of all possible variations of the invention. Parts and percentages are by weight unless otherwise indicated.

EXAMPLES

SYNTHESIS AND PROPERTIES OF THE Te(II) COORDINATION COMPLEXES

The Te(II) coordination complexes of this invention are typically prepared by reacting the sulfur ligand, e.g., a thiourea type compound or a salt of a 1,1-dithio type ligand as defined above, with an aqueous solution of the Te(4+) chloro complex, $\{TeCl_6\}(2-)$, prepared by dissolving tellurium dioxide, $TeO_2$, in hydrochloric acid or a hydrochloric acid-acetic acid mixture with warming. The stoichiometry of the Te(II)-thiourea complexes, i.e., $Te(tu)_nX_2$, n=2 or 4, is determined by the molar ratio of thiourea to Te(4+) used in the reaction. With a ratio of ca 4:1, the bis complexes are obtained:

$$Te(4+) + 4H_2N\overset{\overset{\displaystyle S}{\|}}{C}NH_2 + 2X^- \longrightarrow Te\{SC(NH_2)_2\}_2 + \{(NH_2)_2C-S-S-C(NH_2)_2\}^{2+}$$

X = Cl, Br, I, SCN

In these reactions the thiourea is used both as a reducing agent, i.e., Te(4+)→Te(2+), and also as a stabilizing ligand for Te(II), preventing its reduction to elemental tellurium. Using a 6:1 or greater ratio of thiourea/Te(4+), the tetrakis complexes, $\{Te(tu)_4\}X_2$ are formed in these reactions.

The molecular complexes with 1,1-dithio type ligands, $\{Te(S_2X)_2\}$, can also be prepared by substitution reactions between the labile Te(II) complex, $Na_2\{Te(S_2O_3)_2\}.2H_2O$, and two equivalents of a salt of the 1,1-dithio ligands—typically sodium or potassium salts are used. These reactions are carried out in aqueous solution with previously isolated $Na_2\{Te(S_2O_3)_2\}.2H_2O$, prepared as described in O. Foss, Inorganic Synthesis, 4, 89 (1953), or with this complex generated in-situ by the reduction of $\{TeCl_6\}(2-)$ with excess sodium thiosulfate in an ice bath as described in Examples below. The molecular complexes precipitate from the reaction solutions and, after isolation by filtration, washing with water and drying, they can be purified by recrystallization from organic solvents. The thermal stabilities of these complexes vary, depending on the nature of the bidentate sulfur ligand used but, in general, they exhibit enhanced stability compared to the above Te(II) complexes with monodentate thiourea ligands. Thus, by proper choice of Te(II) complex, as well as the length and temperature of the emulsion finishing step, the rate of introduction of tellurium sensitization centers can be readily controlled using the Te(II) complexes of this invention.

EXAMPLE 1

SYNTHESIS OF $\{Te(thiourea)_2Cl_2\}$

Tellurium dioxide (3.2 g, 20 mmoles) was dissolved, with warming, in 50 ml. of conc. HCl and 50 ml of water at 85° C. To the resulting yellow solution was added a solution of thiourea (6.1 g, 80 mmoles) dissolved in 75 ml of warm water. The yellow solution immediately turned red, and on cooling the reaction solution to 30° C. a crop of bright yellow crystals deposited. After further stirring for 10 min., the solid was isolated by filtration and vacuum dried {6.6 g (94% yield): Calcd. (Found) for $C_2H_8N_4S_2Cl_2Te$ (M.W.=350.75): C, 6.85 (6.71); H, 2.30 (2.22); N, 15.97 (15.93); S, 18.28) (18.20)}.

EXAMPLE 2

SYNTHESIS OF $\{Te(thiourea)_4\}Cl_2.2H_2O$ $TeO_2$ (4.8 g, 30 mmoles) was dissolved with warming in a solution of 20 ml concentrated hydrochloric acid and 20 ml of water. To the resulting yellow solution (85° C.) was added a solution of thiourea (15 g, 198 moles) dissolved in 100 ml of warm water. Cooling the resulting red reaction solution to 30° C. gave a crop of yellow crystals which were isolated by filtration and vacuum dried {yield=15.2 g (94%): Calcd. (Found $C_4H_{20}N_8O_2S_4Cl_2Te$ (F.W.=539.02): C, 8.91 (8.75); H, 3.74 (3.5); N, 20.79 (20.36); S, 23.80 (23.5)}

EXAMPLE 3

SYNTHESIS OF $\{Te(thiourea)_2Br_2$

Tellurium dioxide (3.2 g, 20 moles) was dissolved, with warming, in 50 ml. of conc. HBr and 50 ml of water at 85°

C. To the resulting yellow solution was added a solution of thiourea (6.1 g, 80 moles) dissolved in 75 ml of warm water. The yellow solution immediately turned red and on further stirring for ca. 1 min. a heavy orange precipitate began to deposit. The reaction solution was further stirred for 10 min. and the orange solid was isolated by filtration and vacuum dried {8.35 g (95%): Calcd. (Found) for $C_2H_8N_4S_2Br_2Te$ (M.W.=439.65): C, 5.46 (5.2); H, 1.83 (1.9); N, 12.75 (12.5); S, 14.59 (14.0); Te, 29.02 (30.3)}. This product is moderately soluble in N,N-dimethylformamide and methanol. Concentration of the above aqueous filtrate gave a crop of the thiourea oxidation product as yellow crystals, i.e., the formamidinium disulfide salt $\{(H2N)_2C\text{-}S\text{-}S\text{-}C(NH_2)_2\}Br_2$.

EXAMPLE 4

SYNTHESIS OF $Te(S_2CO\text{-}i\text{-}Pr)_2$

To a solution of 17.3 g (40 moles) of $Na_2\{Te(S_2O_3)_2\}.2H_2O$, prepared as described in O. Foss, Inorganic Synthesis, 4, 89 (1953) dissolved in 750 ml of water at −5° C. was slowly added, from a dropping funnel, a solution of 17.4 g (100 moles) of $KS_2CO\text{-}i\text{-}C_3H_7$ (prepared by reacting $CS_2$ with an isopropanol solution of potassium hydroxide as described in L. C. Blackman and M. J. Dewar, J. Chem. Soc., 162 (1957)) dissolved in 200 ml of water. After addition of all the potassium isopropyl xanthate solution, the reaction solution was stirred a further 15 minutes, and the brown solid which had precipitated was isolated by filtration, washed well with water, and air dried to give 13.8 grams of crude product. The crude product was recrystallized from 600 ml of 2:1 i-propanol-benzene to give 10.7 g of red needles (67%). This complex, bis(iso-propylxanthato) tellurium(II), is soluble in N,N-dimethylformamide, acetone, methylene chloride, toluene and methanol, but insoluble in water. Calcd. (Found) for $C_8H_{14}O_2S_4Te$ (MW=398.06): C, 24.14 (24.17); H, 3.55 (3.35); S, 32.22 (32.36)

EXAMPLE 5

SYNTHESIS OF $Te(S_2COEt)_2$

This example illustrates the synthesis of Te(II) complexes with 1,1-dithio type ligands using in-situ generated $\{Te(S_2O_3)_2\}(2-)$.

Tellurium dioxide (1.6 g, 10 mmoles) was dissolved with warming in a mixture of 4 ml of conc. HCl and 7 ml of glacial acetic acid. After complete dissolution of the $TeO_2$, the solution was cooled to −10° C. in an ice-salt bath and a solution of 10 g of sodium thiosulfate pentahydrate ($Na_2S_2O_3.5\ H_2O$) in 5 ml of water was added dropwise to the above solution (maintained at −10° C. in the cold bath). After addition of all the sodium thiosulfate solution, an additional 25 ml of the hydrochloric acid-glacial acetic acid mixture (at −10° C.) was added. To the resulting solution (kept in the −10° C. cold bath) a solution of $KS_2COEt$ (4.8 g, 30 mmoles dissolved in 150 ml of water) was added dropwise from a separatory funnel. After complete addition of the potassium ethyl xanthate solution, the reaction solution (containing a red-brown precipitate) was diluted to 1 L with water and stirred another 15 minutes at room temperature, and the solid was isolated by filtration and washed well with water. The isolated solid was vacuum dried and then recrystallized from 150 ml of 1:1 toluene-ethanol (65° C.) to give 1.9 g (51%) of the complex as red needles (Calcd. (Found) for $C_6H_{10}O_2S_4Te$ (M.W.=370.01): C, 19.48 (19.3); H, 2.72 (2.5); S, 34.67 (34.9); Te, 34.49 (34.2)).

EXAMPLE 6

SYNTHESIS of $Te(S_2CO\text{-}i\text{-}C_4H_9)_2$

Tellurium dioxide (1.6 g, 10 mmoles) was dissolved with warming in a mixture of 4 ml of conc. HCl and 7 ml of glacial acetic acid with warming. After complete dissolution of the $TeO_2$, the solution was cooled to −10° C. in an ice-salt bath, and a solution of 10 g of sodium thiosulfate pentahydrate ($Na_2S_2O_3.5\ H_2O$) in 5 ml of water was added dropwise to the above solution (maintained at −10° C. in the cold bath). After addition of all the sodium thiosulfate solution, an additional 25 ml of the hydrochloric acid-glacial acetic acid mixture (at −10° C.) was added. To the resulting solution (kept in the −10° C. cold bath) a solution of $KS_2CO\text{-}i\text{-}C_4H_9$ (5.6 g, 30 mmoles dissolved in 125 ml of water) was added dropwise from a separatory funnel. After complete addition of the potassium i-butyl xanthate solution, the reaction solution (containing a red precipitate) was diluted to 1 L with water and stirred another 15 minutes at room temperature, and the solid was isolated by filtration and washed well with water. The isolated solid was vacuum dried and then recrystallized from 100 ml of i-butanol (80° C.) to give 2.7 g (63.4% yield) of the complex as red needles (Calcd. (Found) $C_{10}H_{18}O_2S_4Te$ (M.W.=426.12): C, 28.19 (28.0); H, 4.26 (4.3); S, 30.10 (30.0); Te, 29.95 (30.3)).

EXAMPLE 7

SYNTHESIS OF $Te(S_2CO\text{-}n\text{-}C_5H_{11})_2$

Tellurium dioxide (1.6 g, 10 mmoles) was dissolved with warming in a mixture of 4 ml of conc. HCl and 7 ml of glacial acetic acid with warming. After complete dissolution of the $TeO_2$, the solution was cooled to −10° C. in an ice-salt bath, and a solution of 10 g of sodium thiosulfate pentahydrate ($Na_2S_2O_3.5\ H_2O$) in 5 ml of water was added dropwise to the above solution (maintained at −10° C. in the cold bath). After addition of all the sodium thiosulfate solution, an additional 25 ml of the hydrochloric acid-glacial acetic acid mixture (at −10° C.) was added. To the resulting solution (kept in the −10° C. cold bath) a solution of $KS_2CO\text{-}n\text{-}C_5H_{11}$ (6.5 g, 30 mmoles) dissolved in 150 ml of water) was added dropwise from a separatory funnel. After complete addition of the potassium amyl xanthate solution, the reaction solution, containing an orange-brown precipitate, was stirred for 15 min. at room temperature and then diluted to 1 L with water, stirred another 5 min., and the precipitate was isolated by filtration, washed well with water, and vacuum dried to give 4.2 g of an orange-brown powder (92.5% yield). This crude product was then recrystallized from 225 ml of 4:1 n-butanol-benzene (60° C.) to Give a crop of orange needles (2.1 g; 46.3% yield; Calcd. (Found) $C_{12}H_{22}O_2S_4Te$ (M.W.=454.16): C, 31.37 (31.5); H, 4.88 ( 4.4); S, 28.24 (28.5); Te, 28.10 (28.1)).

EXAMPLE 8

SYNTHESIS of $Te(S_2CO\text{-}n\text{-}C_{12}H_{25})_2$

To a solution of 8.7 g (20 mmoles) of $Na_2\{Te(S_2O_3)_2\}.2H_2O$, prepared as described in O. Foss, Inorganic Synthesis, 4, 89 (1953), dissolved in 500 ml of water at −5° C. was slowly added, from a dropping funnel, a solution of 15 g (50 mmoles) of $KS_2CO\text{-}n\text{-}C_{12}H_{25}$, prepared by reacting $CS_2$ with a n-dodecanol solution of potassium hydroxide as described in L. C. Blackman and M. J. Dewar, J. Chem. Soc., 162 (1957), dissolved in 500 ml of methanol. After addition of all the potassium n-dodecyl xanthate solution, the reaction solution, containing a heavy brown precipitate, was further stirred for 30 min. at room temperature, and the precipitate was isolated by filtration, washed well with water and methanol, and vacuum dried to give 11.9 g of a brown powder (91.5% yield). This crude product was recrystallized from 350 ml of 2:1 isopropanol-benzene (75° C.). Filtration of this hot solution through a medium porosity glass frit, followed by cooling overnight at −10° C. gave a crop of an orange fibrous solid (8.2 g (63%); Calcd. (Found) for $C_{2650}O_2S_4Te$ (MW=650.52): C, 48.0 (47.6); H, 7.75 (8.3); S, 19.73(20.1)).

EXAMPLE 9

SYNTHESIS OF $Te\{S_2CN(CH_2CH_2OH)_2\}_2$

To a suspension of $\{Te(thiourea)_4\}Cl_2.2H_2O$ (5.03 g, 10 mm), prepared as in Example 2, in 50 ml of methanol was added a methanol solution of 51 mm of $HS_2CN(CH_2CH_2OH)_2$, prepared in situ by reacting $HN(CH_2CH_2OH)_2$ (51 mm; 3.0 ml) and 4.9 g of $CS_2$ in 40 ml of methanol-water (4:1). After stirring the reaction solution for 1 hr, it was diluted to 400 ml with water to give a red oil. The aqueous solution was decanted from the red oil and the oil was washed with two-100 ml portions of water. The red oil was then recrystallized from 150 ml of hot methanol. After filtering the methanol solution, concentrating the filtrate to 50 ml and cooling overnight in a refrigerator, a peach solid deposited which was isolated by filtrate, washed with 30 ml of cold MeOH and vacuum dried (yield=3.2 g; Calcd. (Found) for $C_{10}H_{20}N_2O_4S_4Te$, M.W.= 488.14: C, 24.61 (24.4); H, 4.13 (3.88); N, 5.74 (5.62); S, 26.28 (7.08)).

EXAMPLE 10

SYNTHESIS OF $Te\{S_2CN(n\text{-}C_4H_9)_2\}_2$

Tellurium dioxide (1.6 g, 10 mmoles) was dissolved in a mixture of 4 ml of conc. HCl and 7 ml of glacial acetic acid with warming. After complete dissolution of the $TeO_2$, the solution was cooled to −10° C. in an ice-salt bath, and a solution of 10 g of sodium thiosulfate pentahydrate ($Na_2S_2O_3.5\ H_2O$) in 5 ml of water was added dropwise to the above solution (maintained at −10° C. in the cold bath). After addition of all the sodium thiosulfate solution, an additional 25 ml of the hydrochloric acid-glacial acetic acid mixture at −10° C. was added. To the resulting solution (kept in the −10° C. cold bath) a solution of $NaS_2CN(n\text{-}Bu)_2$ (6.82 g, 30 mmoles) dissolved in 150 ml of water was added dropwise from a separatory funnel. After complete addition of the sodium di(n-butyl)dithiocarbamate solution, the reaction solution, containing a red-brown precipitate, was stirred for 15 min. at room temperature and then diluted to 1 L with water, stirred another 5 min. and the precipitate was isolated by filtration, washed well with water, and vacuum dried to give 5.1 g of a red-brown powder (95% yield). This crude product was then recrystallized from 250 ml of 1:1 ethanol-benzene (60° C.) to give a crop of dark red crystals (3.9 g; 72.8% yield; Calcd. (Found) $C_{18}H_{36}N_2S_4Te$ (M.W.= 536.36): C, 40.31 (40.5); H, 6.77 (6.4); S, 23.91 (23.5)).

EXAMPLE 11

SYNTHESIS of $Te\{S_2P(OEt)_2\}_2$ $TeO_2$ (4.8 g, 30 mm) was dissolved in 25 ml of concentrated HCl with warming. The resulting clear yellow solution was diluted with 75 ml of water and cooled to −10° C. in an ice-salt bath. To this cold solution was added, dropwise, a solution of $NH_4\{S_2P(OEt)_2\}$ (24.4g, 120 mm) in 200 ml of water. The reaction solution was allowed to warm to room temperature and stirred for 1 hr. The aqueous solution was then decanted from the gummy red product, and it was further washed with 2–100 ml portions of water. Trituration of the gummy red product with 200 ml of ethanol gave an orange powder which was isolated by filtration and air dried (yield: 11.4 g). This product was recrystallized from 250 ml of 60° C. ethanol. Cooling the bright red filtrate overnight in a refrigerator gave a crop of deep red crystals 5.2 g) (Calcd. (Found) for $C_8H_{20}O_4P_2S_4Te$ (M.W.= 498.06): C, 19.29 (19.37); H, 4.05 (4.10); S, 25.75 (25.62); P=12.44 (12.12)) .

EXAMPLE 12

SENSITIZATION OF MONODISPERSE AgBr TABULAR EMULSIONS WITH TELLURIUM(2+) COORDINATION COMPLEXES

A monodisperse AgBr tabular emulsion, prepared as taught in U.S. Pat. No. 5,147,771, with an equivalent circular diameter of 2.4 μm and a thickness of 0.138 μm was treated with the tellurium compounds to sensitize at a variety of levels and temperatures for 20 minutes as shown in TABLE 2. Once the chemical digestion was complete the example emulsions were cooled and coated on a film support at 1614 mg Ag $m^{-2}$ and 3230 mg gel $m^{-2}$. A 1614 mg gel $m^{-2}$ overcoat was applied over the emulsion containing layers. The coatings were then dried and exposed (0.1 s, 365 nm source) through a graduated density step wedge, processed (6 minutes at 20° C.) in KODAK Rapid X-ray Developer, washed, and dried. Speeds are expressed as the relative exposure required to increase the measured density to 0.15 above fog.

TABLE 2

Sensitization of the AgBr Tabular Emulsion by Te Compounds

| Formula | Amount added (μmole) | Temperature | Relative Speed |
|---|---|---|---|
| — | — | — | 100 |
| (a) $Na_2S_2O_3$ | 25 | 60 | 380 |
| (b) $Te{=}P(i\text{-}Pr)_3$ | 10 | 40 | 48 |
| (c) $Te(p\text{-anisyl})_2$ | 25 | 40 & 60 | 100 |
| $Te(thiourea)_4Cl_2$ | 25 | 60 | 646 |
| $Te(S_2COEt)_2$ | 10 | 40 | 251 |
| $Te(S_2CO\text{-}i\text{-}Pr)_2$ | 25 | 60 | 603 |
| $Te(S_2CO\text{-}i\text{-}Bu)_2$ | 10 | 60 | 676 |
| $Te(S_2COC_{12}H_{25})_2$ | 10 | 60 | 724 |
| $Te(S_2NH(CH_2CH_2OH)_2)_2$ | 25 | 40 | 646 |

(a) Comparative example
(b) Comparative example with compound described in U.S. Pat. No. 5,215,880(1993)
(c) Comparative example with compound described in Japanese Patent Application No. 57817/53 (1978)

The invention has been described in detail with particular reference to preferred embodiments thereof, but it will be understood that variations and modifications can be effected within the spirit and scope of the invention.

We claim:

1. A silver halide emulsion comprising silver halide grains and a tellurium compound represented by Formula I:

$$TeL_nX_2$$

wherein

L is thiourea or substituted thiourea, or selenourea or substituted selenourea, n is 2 or 4, X is Cl, Br, I, OCN, SCN, SeCN, TeCN, or $N_3$ or Formula II

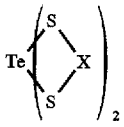

wherein

X is COR, CSR, $CNR_2$, CR, CAr, $PR_2$, $P(OR)_2$

R is alkyl or aryl wherein said tellurium compound is a sensitizer located on the surface of said grains.

2. The emulsion of claim 1 wherein said tellurium compound is present in an amount between 0.1 and 100 μmol/mol Ag.

3. The emulsion of claim 1 wherein said tellurium compound is present in an amount between 5 and 50 μmol/mol Ag.

4. The emulsion of claim 1 wherein said tellurium compound is selected from the group consisting of $Te(S_2COEt)_2$, $Te(S_2CO\text{-}i\text{-}Pr)_2$, $Te(S_2CO\text{-}i\text{-}Bu)_2$, $Te(S_2COC_{12}H_{25})_2$, and $Te\{S_2CN(CH_2CH_2OH)_2\}_2$.

5. The emulsion of claim 4 wherein said tellurium compound is present in an amount between 5 and 50 μmol/mol Ag.

6. The emulsion of claim 1 wherein R is selected from the group consisting of ethyl, isopropyl, and n-$C_{12}H_{25}$.

7. The emulsion of claim 1 wherein R is $C_nH_{2n+1}$ wherein n=1 to 16.

8. The emulsion of claim 1 wherein L is $$RR'NC(=E)NR''R''',$$

wherein E=S or Se; R, R', R'', and R'''=substituents selected from the group consisting of methyl, ethyl, propyl, iso-propyl, n-butyl, iso-butyl, n-amyl, iso-amyl, hexyl, cyclohexyl, heptyl, octyl, nonyl, decyl, dodecyl, phenyl, p-tolyl, p-anisyl, pentafluorophenyl, and naphthyl.

9. A method of sensitizing silver halide comprising providing silver halide grains and bringing said grains into contact with a tellurium compound represented by Formula I:

$$TeL_nX_2$$

wherein

L is thiourea or substituted thiourea, selenourea or substituted selenourea, n is 2 or 4, X is Cl, Br, I, OCN, SCN, SeCN, TeCN, or $N_3$ or Formula II

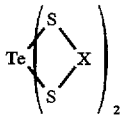

wherein

X is COR, CSR, $CNR_2$, CR, CAr, $PR_2$, $P(OR)_2$

R is alkyl or aryl to sensitize said grains.

10. The method of claim 9 wherein said tellurium compound is selected from the group consisting of $Te(S_2COEt)_2$, $Te(S_2COi\text{-}Pr)_2$, $Te(S_2COi\text{-}Bu)_2$, $Te(S_2COC_{12}H_{25})_2$, and $Te\{S_2CN(CH_2CH_2OH)_2\}_2$.

11. The method of claim 9 wherein said Formula I compound is present in an amount between 0.1 and 100 μmol/mol Ag.

12. The method of claim 9 wherein said compound of Formula I chemically sensitizes said silver halide grain.

13. The method of claim 9 wherein said Formula I compound is present in an amount between 5 and 50 μmol/mol Ag.

14. The method of claim 9 wherein R is selected from the Group consisting of ethyl, isopropyl, and n-$C_{12}H_{25}$.

15. The method of claim 9 wherein R is $C_nH_{2n+1}$ wherein n=1 to 16.

16. The method of claim 10 wherein said Formula I compound is present in an amount between 5 and 50 μmol/mol Ag.

17. The method of claim 9 wherein L is $$RR'NC(=E)NR''R''',$$

wherein E=S or Se; R, R', R'', and R'''=substituents selected from the group consisting of methyl, ethyl, propyl, iso-propyl, n-butyl, iso-butyl, n-amyl, iso-amyl, hexyl, cyclohexyl, heptyl, octyl, nonyl, decyl, dodecyl, phenyl, p-tolyl, p-anisyl, pentafluorophenyl, and naphthyl.

18. The method of claim 9 wherein said emulsion is heated to between 30° and 90° C. to sensitize said emulsion.

19. A silver halide emulsion comprising silver halide grains and a chemical sensitizer for said silver halide grains comprising a tellurium compound represented by Formula I:

$$TeL_nX_2$$

wherein

L is thiourea or substituted thiourea, or selenourea or substituted selenourea, n is 2 or 4, X is Cl, Br, I, OCN, SCN, SeCN, TeCN, or $N_3$ or Formula II

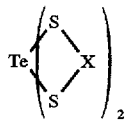

wherein

X is COR, CSR, $CNR_2$, CR, CAr, $PR_2$, $P(OR)_2$

R is alkyl or aryl, wherein said tellurium compound is located on the surface of said grain and said tellurium compound is present in an amount of between 5 and 50 μmol/mol Ag.

20. The emulsion of claim 19 wherein said tellurium compound is selected from the group consisting of $Te(S_2COEt)_2$, $Te(S_2CO\text{-}i\text{-}Pr)_2$, $Te(S_2CO\text{-}i\text{-}Bu)_2$, $Te(S_2COC_{12}H_{25})_2$, and $Te\{S_2CN(CH_2CH_2OH)_2\}_2$.

* * * * *